US005104196A

United States Patent [19]

Boucherie

[11] Patent Number: 5,104,196

[45] Date of Patent: Apr. 14, 1992

[54] BRUSH FILLING MACHINE AND METHOD OF OPERATING SAME

[75] Inventor: Lionel P. Boucherie, Izegem, Belgium

[73] Assignee: G.B. Boucherie N.V., Izegem, Belgium

[21] Appl. No.: 626,525

[22] Filed: Dec. 12, 1990

[30] Foreign Application Priority Data

Dec. 18, 1989 [EP] European Pat. Off. ..... 89123376.9

[51] Int. Cl.[5] ..... A46D 3/04

[52] U.S. Cl. ..... 300/5; 300/11; 300/21

[58] Field of Search ..... 300/2-11, 300/21

[56] References Cited

U.S. PATENT DOCUMENTS

| | | | |
|---|---|---|---|
| 3,059,972 | 10/1962 | Schmidt | 300/5 |
| 4,768,837 | 9/1988 | Boucherie | 300/4 |
| 4,884,849 | 12/1989 | Shaw | 300/4 |
| 4,968,102 | 11/1990 | Boucherie | 300/7 |

FOREIGN PATENT DOCUMENTS

| | | | |
|---|---|---|---|
| 1938937 | 2/1971 | Fed. Rep. of Germany | 300/5 |
| 3146183 | 5/1983 | Fed. Rep. of Germany . | |

*Primary Examiner*—Mark Rosenbaum

*Attorney, Agent, or Firm*—Sixbey, Friedman, Leedom & Ferguson

[57] ABSTRACT

A brush filling machine is provided wherein two brush bodies are supplied at one time to one lateral gripping face of a rotary turret while two other brush bodies are being filled with fiber tufts on an adjacent lateral gripping face of the turret. The turret is indexed after each completed brush body filling cycle to present a new pair of brush bodies to be filled with fiber tufts by a pair of filling tools I. A specific arrangement of the various operating units of the machine is disclosed which permits the spacing a between the pair of filling tools, to be minimized thereby reducing the required radial dimensions of the rotary turret. Due to the low inertia of the rotary turret, the indexing thereof can be performed within the time of one filling stroke so that indexing of the turret causes no wait state of the filling tools.

28 Claims, 6 Drawing Sheets

Fig. 8
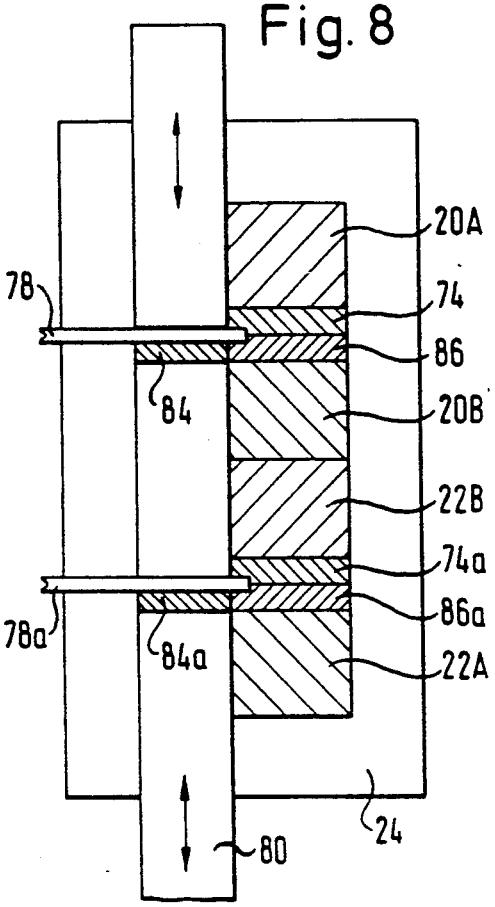
Fig. 7
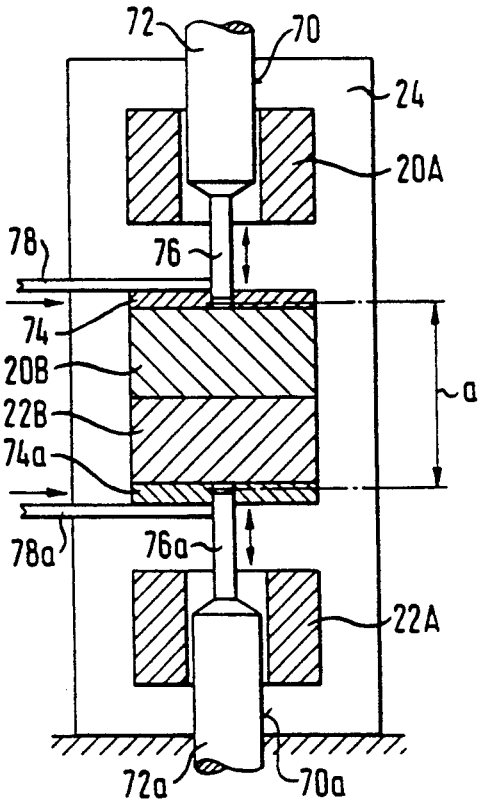
Fig. 9
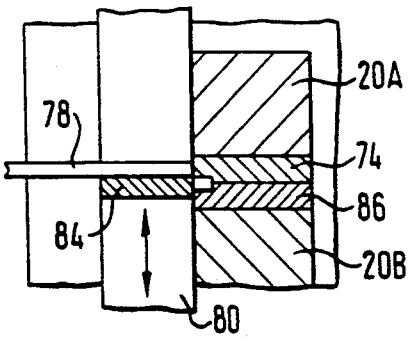
Fig. 11
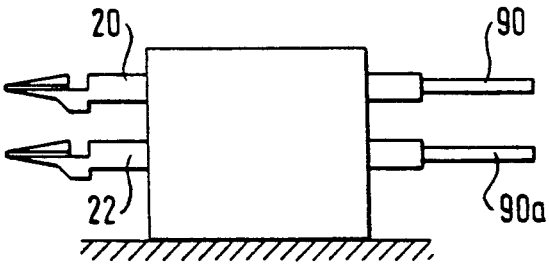
Fig. 13
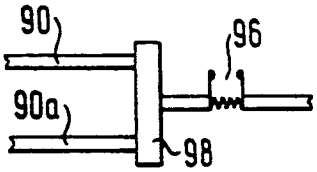
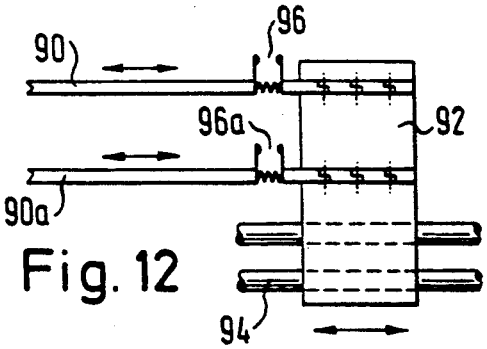
Fig. 12

BRUSH FILLING MACHINE AND METHOD OF OPERATING SAME

The present invention relates to a brush filling machine and to a method of operating the brush filling machine.

Modern brush filling machines have a rotary turret mounted in a machine frame and having four lateral brush body gripping faces. Each brush body gripping face of the turret is successively supplied with a brush body, indexed by an angle of e.g. 90° to be presented to a filling tool and then indexed to a position where the filled brush bodies are removed from the turret and taken over by a take-off system.

To increase the operating speed of a brush filling machine it has been proposed (DE 31 46 183 A1) to use a turret with a pair of brush body gripping means on each lateral gripping face of the turret and a pair of simultaneously operating filling tools. From a practical point of view, however, it has not been possible to substantially increase the operating speed of the brush filling machine because the indexing of the turret to present a pair of new brush bodies to the pair of filling tools requires considerable time during which the filling tools are inoperative. In fact, the indexing speed of the turret is limited by the dimensions of the turrent which, in turn, are dependent on the spacing between two adjacent brush bodies on each of the lateral gripping faces of the turret. The spacing between two adjacent brush bodies on each lateral gripping face of the turret is in turn determined by the required spacing between the pair of filling tools. The spacing between the pair of filling tools is determined by the space requirements of each filling tool and its associated operating units. These operating units include a fiber tuft supply box, a tuft picker for feeding individual fiber tufts from the fiber tuft supply box to the associated filling tool in each filling stroke, an anchor wire feed system with an associated punch member for supplying individual anchors to the filling tool for each fiber tuft to be anchored in a brush body, and a tuft driver member for driving each fiber tuft and the associated anchor into the brush body.

The present invention provides a brush filling machine wherein the spacing of two adjacent brush bodies on each lateral gripping face of the turret is reduced to a minimum value so that the indexing speed of the turret can be increased. The specific arrangement of the various operating units of the inventive brush filling machine allows the pair of filling tools to have a minimum spacing from each other so that the corresponding spacing of the pair of brush bodies on the lateral gripping faces of the turret can be correspondingly reduced.

More specifically, the present invention provides a brush filling machine having a frame, a rotary turret mounted in the frame, a brush body feeding system for supplying brush bodies to the turret, a take-off system for removing filled brush bodies from the turret and a pair of filling tools having their fiber tuft delivery openings facing one of a plurality of lateral gripping faces of the turret, each gripping face of the turret having gripping means for releasably holding a pair of adjacent brush bodies; the brush filling machine being characterized in that the pair of filling tools have their tools slides slidably mounted in a common filling tool box in a parallel and adjacent relationship, both tool slides of the pair being connected to a common tool slide drive, that each filling tool has an anchor wire feed channel extending transverse to the direction of sliding movement of the tool slides and opening next to the opposed faces of two adjacent tool slides, each filling tool having a punch member mounted for reciprocating movement in the filling tool box transverse to the sliding movement direction of the tool slides and having a cutting edge adjacent to the open end of an associated anchor wire feed channel. In addition, according to a first aspect of the invention, each filling tool has a tuft picker member reciprocatingly pivoting about a common axis parallel to the axis of reciprocating movement of said punch members, the tuft picker members being parallel and spaced from each other and being connected to a common tuft picker drive, and in that each tuft picker member cooperates with an associated fiber supply box, the fiber supply boxes of both filling tools being mounted on top of each other. According to a second, alternative aspect of the invention, a strand of parallel fibers is supplied to each filling tool from a spool or a number of spools transverse to the sliding movement of the tool slides, and a tuft cutter is associated with each filling tool to cut off individual fiber tufts from the fiber strand, said tuft cutters being connected to a common tuft cutter drive. In the brush filling machine of the present invention, the specific arrangement of the various operating units, i.e. the tool slides, the fiber tuft supply boxes and the anchor wire feed channels with the associated punch members, is optimized to minimize the required spacing between the pair of filling tools. This, in turn, allows the brush bodies on each lateral gripping face of the turret to have a minimum spacing from each other thereby reducing the radial dimensions of the turret. The radial dimensions of the turrent are the governing parameter with respect to the maximum attainable indexing speed of the turret. In the brush filling machine of the present invention, the indexing speed of the turret is compatible with the operating speed of the filling tools. This means that the filling tools can be operated continuously without waiting for presenting a new pair of brush bodies after the filling of a preceding pair of brush bodies has been completed.

Accordingly, the present invention provides a method of operating a brush filling machine of the type defined above, wherein two brush bodies are supplied to one lateral gripping face of the turret while two other brush bodies are being filled with fiber tufts on an adjacent lateral gripping face of the turret and two further, filled brush bodies are removed from a further lateral gripping face of the turret, the turret being indexed after each completed brush body filling cycle to present a new pair of brush bodies to be filled with fiber tufts to the filling tools, each of the filling tools performing one of successive filling strokes for each fiber tuft to be anchored in the respective brush body; the method being characterized in that the indexing of the turret is performed within the time of one of the filling strokes so that indexing of the turrent causes no wait state of the filling tools.

Several advantageous embodiments of the present invention are defined in the dependent claims.

Further advantages and features of the present invention stand out from the following description with reference to the drawings, wherein:

FIG. 7 shows a first embodiment of an anchor wire punch arrangement in the filling tool box of the brush filling machine, FIG. 8 shows a second embodiment of an anchor wire punch arrangement in the filling tool box of the brush filling machine;

FIG. 9 is a partial view of the punch and cooperating cutting and guiding plates in the arrangement of FIG. 8;

FIG. 11 is a schematic side view of a pair of filling tools with their tuft drive members;

FIG. 12 is a partial view of a first embodiment of the connection of the tuft driver members to a common actuator;

FIG. 13 shows another embodiment of the connection of the tuft driver members to the common actuator;

Figure 1:
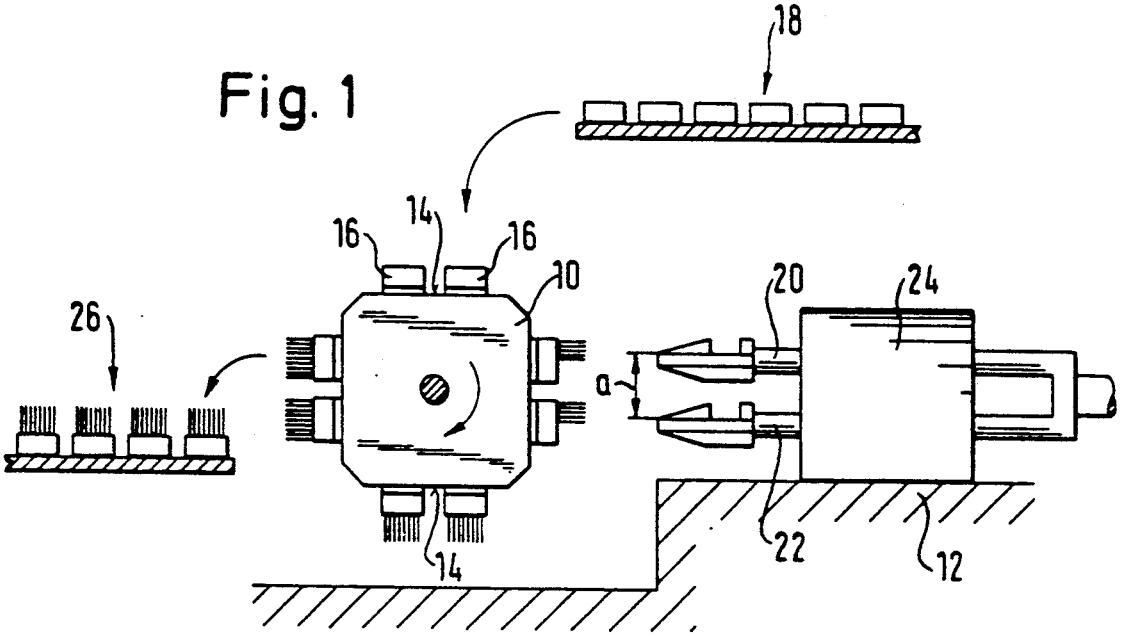
FIG. 1 is a schematic side view of a rotary turret, a filling tool box, a brush body feeding system and a take-off system in a brush filling machine of the present invention.

The brush filling machine schematically shown in FIG. 1 has a rotary turret 10 mounted in a machine frame 12. The turret 10 has four lateral gripping faces 14 dimensioned to accommodate a pair of adjacent brush bodies 16 to be filled with fiber tufts. A brush body feeding system 18 supplies pairs of brush bodies 16 to the respectively upper lateral gripping face 14 of the turret 10. The turret 10 is adapted to be indexed in steps of 90° rotation in a clockwise sense in FIG. 1 to present its gripping face 14 supplied with fresh brush bodies 16 to a pair of filling tools 20, 22 mounted in a common filling tool box 24. When the brush bodies have been completely filled with fiber tufts by the filling tools 20, 22 the turret 10 is again indexed to present new brush bodies to the pair of filling tools 20, 22 and to present a pair of filled brushes to a take-off system 26 which will normally transport the filled brushes to further processing units of the machine, for example to a trimming station where the ends of the fiber tufts are trimmed to the desired length.

As is apparent from FIG. 1, adjacent brush bodies 16 on a lateral gripping face 14 of the turret 10 are spaced from each other by a minimum amount which is determined by the spacing a between the longitudinal axis of the filling tools 20, 22. The specific arrangement of the various operating units of the inventive brush filling machine as will be disclosed in detail with reference to FIGS. 2 to 14, allows the spacing a to be minimized, thereby reducing the radial dimension of the rotary turret 10, i.e. the dimension which governs the maximum attainable indexing speed of the turret.

The common filling tool box 24 may be formed of a single body or casing, or composed of two assembled filling tool box parts which are each associated with one filling tool.

Figure 2:
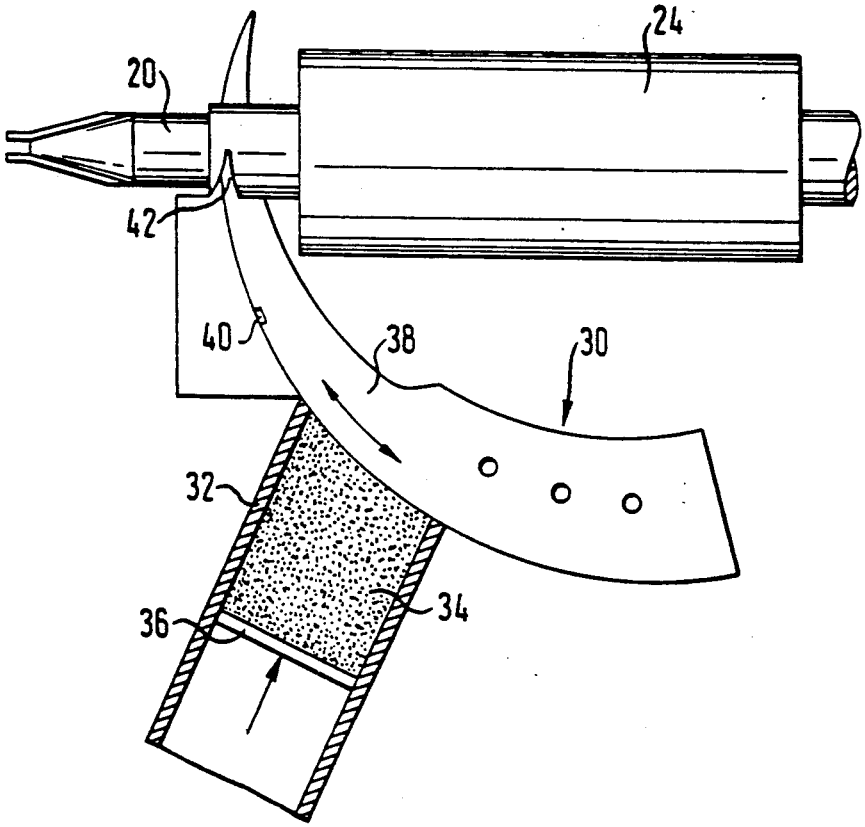
FIG. 2 is a schematic top view of a filling tool, a tuft picker unit and a fiber supply box for use in the inventive brush filling machine.

FIG. 2 shows the relationship between the upper filling tool 20, the associated tuft picker unit 30 and the corresponding fiber tuft box 32. This arrangement is basically known from DE 29 14 698 A1, for example. The fiber supply box 32 contains many individual fibers 34 in an upright position which are urged by a pressure device 36 against the arcuate outer surface of tuft picker member 38. The tuft picker member 38 is mounted for pivotal reciprocating movement along the path described by its arcuate outer surface so that a notch 40 formed in this outer surface passes in front of the fiber supply box 32 to pick off a tuft of fibers which are then introduced into a gap 42 of the filling tool 20. As is well known, e.g. from DE 29 14 698 A1, the filling tool has a central channel which opens on the front tip and which receives individual fiber tufts via the gap 42. In addition to the fiber tuft presented to the central channel through the gap 42, an anchor cut off from an anchor wire is introduced into the central channel, and a tuft driver member slidingly received in the rear part of the central channel of the filling tool 20 is periodically advanced to drive each fiber tuft with its anchor through the forward portion of the central channel and out of its end on the tool tip and into an opposed hole of a brush body 16.

Figure 3:
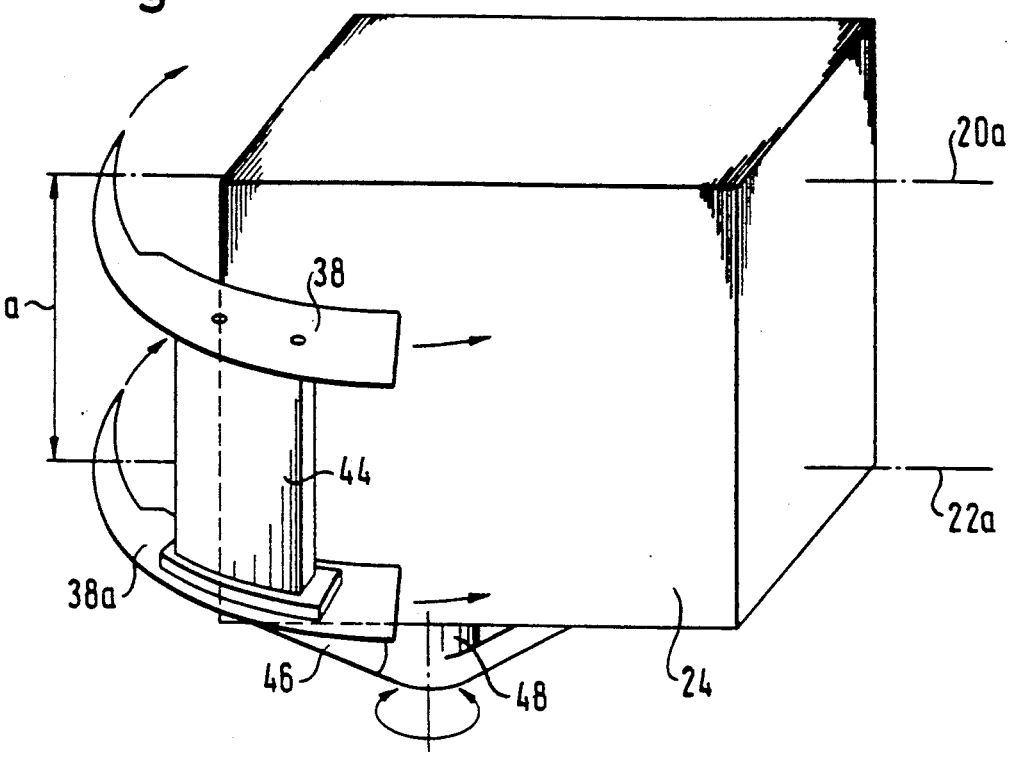
FIG. 3 shows a first embodiment of a twin tuft picker arrangement of the brush filling machine.

In the embodiment of FIG. 3, only the axes 20*a*, 22*a* of the filling tools 20, 22 are shown for clarity. Each filling tool has its associated tuft picker member 38, 38*a*. The tuft picker members 38, 38*a* are interconnected by a spacer 44. Tuft picker member 38*a* is connected to one arm 46 of a two-armed lever 48 which is pivotally mounted on the lower side of the filling tool box 24. The other arm of the two-armed lever 48 is connected to a conventional tuft picker drive (not shown).

Figure 4:
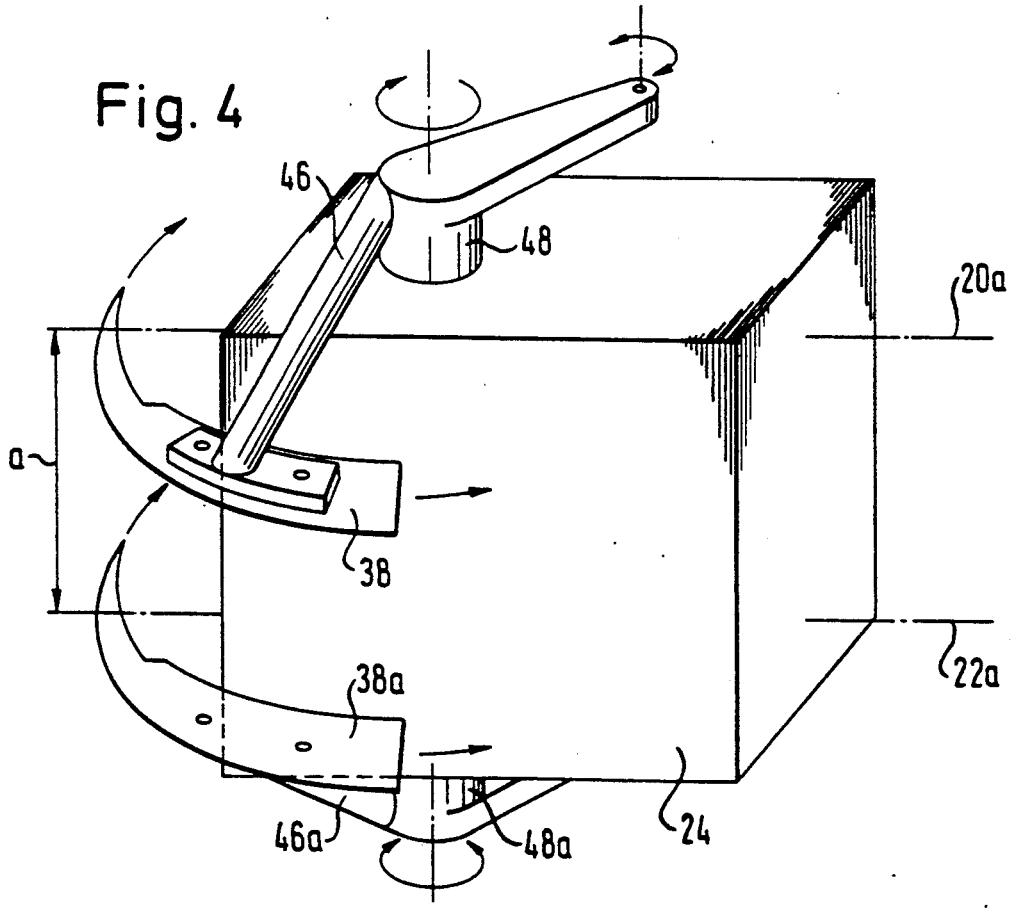
FIG. 4 shows a second embodiment of the twin tuft picker arrangement.

In the embodiment of FIG. 4, each tuft picker member 38, 38*a* has its own holding arm (46, 46*a*) on an associated two-armed lever 48, 48*a*, the other arm of lever 48, 48*a* being connected to a common conventional tuft picker drive (not shown). The two-armed levers 48, 48*a* are pivotally mounted on the opposed upper and lower faces of the filling tool box 24.

Figure 5:
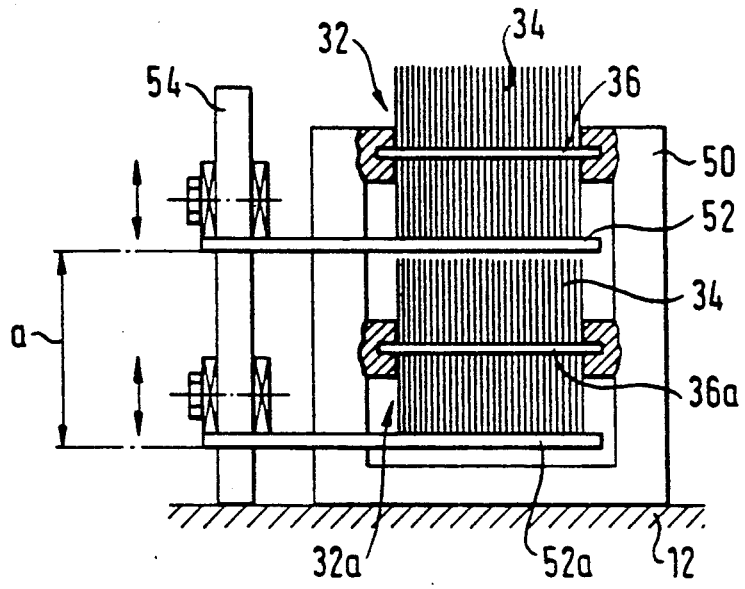
FIG. 5 shows a first embodiment of a twin fiber supply box arrangement.

FIG. 5 shows the arrangement of the fiber supply boxes associated with the pair of filling tools 20, 22. A common frame 50 is provided for defining two fiber supply boxes 32, 32*a* on top of each other. The fibers 34 are received in an upright position in each fiber supply box and rest with their lower ends on an associated bottom plate 52, 52*a*, the bottom plates 52, 52*a* being carried by a stand 54 mounted on the machine frame 12. The bottom plates 52, 52*a* are individually or simultaneously adjustable in height for adaptation to different le*ngths of fibers 34. The height of each bottom plate 52, 52*a* is adjusted so that the center of the fibers 34 is on the level of the central axis 20*a*, 22*a* of the corresponding filling tool 20, 22. Accordingly, the spacing of the bottom plates 52, 52*a* corresponds to the spacing a of the filling tool axis 20*a*, 22*a*. Each fiber supply box 32, 32*a* has an associated pressure device 36, 36*a* for urging the fibers 34 against the associated tuft picker member 38, 38*a*.

Figure 6:
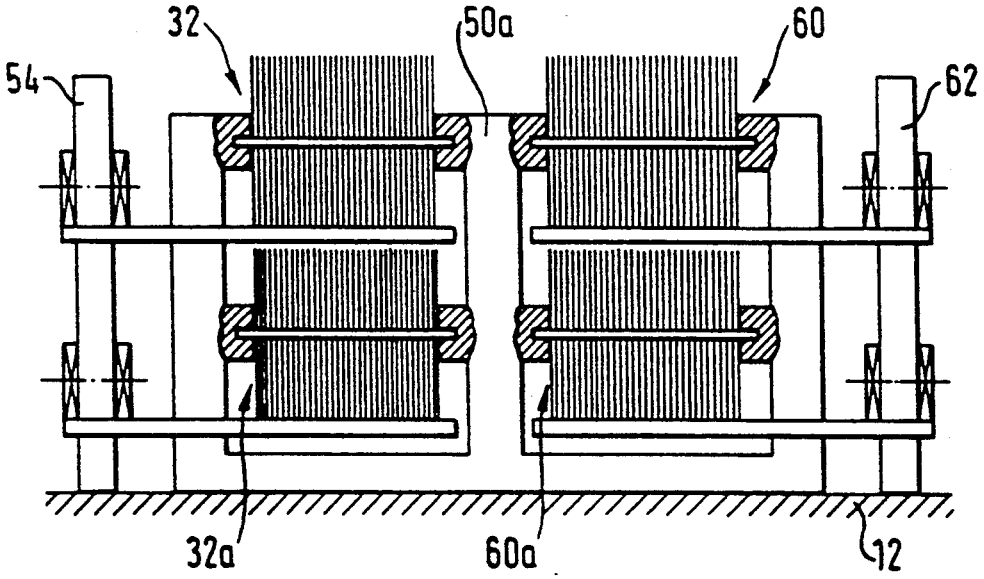
FIG. 6 shows a second embodiment of the fiber box arrangement which includes a pair of fiber boxes for each filling tool.

The embodiment of FIG. 6 is generally similar to that of FIG. 5, but there is a pair of fiber supply boxes 32, 60 and 32*a*, 60*a* associated with each filling tool 20, 22. A common frame 50*a* is provided which carries the two pairs of fiber supply boxes 32, 60 and 32*a*, 60*a*. An additional stand 62 is provided for carrying the bottom plates of the additional fiber supply boxes 60, 60*a*. The additional fiber supply boxes 60, 60*a* can receive fibers different in nature, for example in length or color, from the fibers used in fiber supply boxes 32, 32*a*. Each brush body can thus be filled with different types of fiber tufts. If the length of the fibers in fiber supply boxes 60, 60*a* is different from that of the fibers in fiber supply boxes 32, 32*a*, the respective bottom plates are adjusted to different heights.

FIG. 7 shows a first embodiment of an arrangement of a pair of punch members in a schematic cross-section. The purpose of the punch members is to cut off short ends of a continuous anchor wire to provide the anchors required for fixing the fiber tufts in the holes of the brush bodies. Specifically, the filling tool box 24 has a pair of aligned guiding channels 70, 70*a* in its opposed top and bottom walls for slidingly receiving a punch shaft 72, 72*a* connected to a reciprocating punch drive (not shown). Both punch shafts 72, 72*a* are preferably connected to the same punch drive. In this embodiment of FIG. 7, each filling tool has a tool slide composed of a pair of slide members 20A, 20B and 22A, 22B. Each of the slide members 20A, 20B, 22A, 22B is slidingly received in a corresponding longitudinal channel of the filling tool box 24. The slide members 20B, 22B are directly adjacent each other and on top of each other in the center zone of the filling tool box 24, while slide members 20A, 22A are respectively accommodated in the top and bottom regions of the filling tool box 24. Cutting plates 74, 74*a* are located on the opposed sides of slide members 20B. 22B. Each cutting plate 74, 74*a* cooperates with a punch member 76, 76*a* integrally formed with an associated punch shaft 72, 72*a*. A continuous anchor wire 78, 78*a* is fed through a transverse feed channel to a central position of each cutting plate 74, 74*a* where the cutting plates have a hole which corresponds in shape to the free end of the corresponding punch member 76, 76*a*. In the position shown in FIG. 7, the punch members 76, 76*a* have cut off a short end from the continuous anchor wire 78, 78*a* and pushed the cut off end through the hole in the cutting plate 74, 74*a* to a level which corresponds to the center axis of the corresponding filling tool 20, 22 i.e. to the center channel thereof. As further indicated in FIG. 7, the spacing between the opposed faces of slide members 20B, 22B is the spacing a between the axes of the filling tools 20, 22 (FIG. 1).

Figure 10:
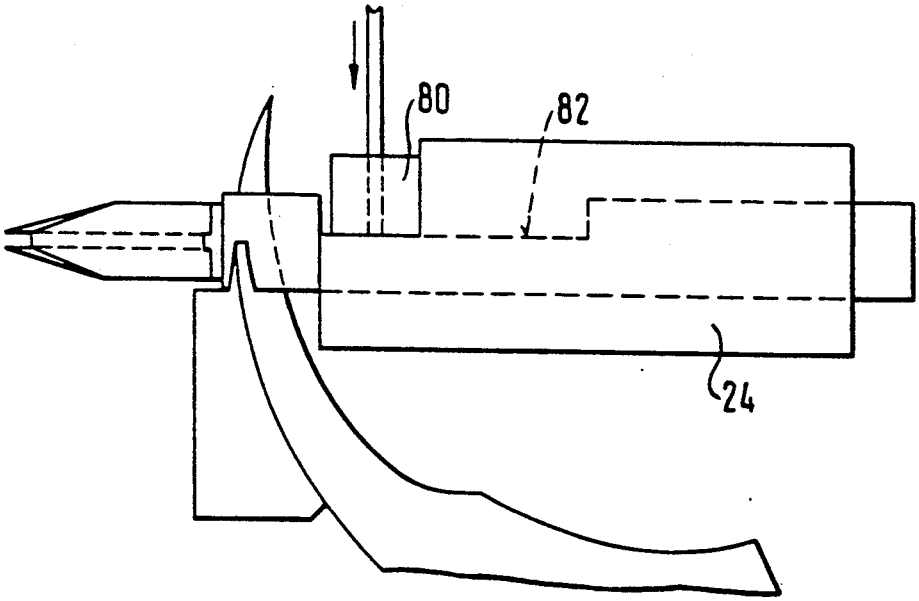
FIG. 10 is a top view showing the cooperating of the punch arrangement of FIG. 8 with the filling tool slide members and the tuft picker unit.

In the embodiment of FIG. 8, a single punch bar 80 cooperates with both filling tools 20, 22. As seen in FIG. 10, each filling tool slide has a lateral recess 82 for accommodation of the punch bar 80, the recess 82 having an axial length substantially corresponding to the operating stroke of the filling tool. Each lateral recess 82 extends radially inwardly to the axial center channel of the tool slide. As seen in FIG. 8, the punch bar 80 carries two spaced punch plates 84, 84*a* for cooperation with a laterally adjacent cutting plate 74, 74*a* associated with slide member 20A, 22B. A guiding plate 86, 86*a* is located below each cutting plate 74, 74*a* to define a slit wherein the end tip of the continuous anchor wire 78, 78*a* is introduced. When the punch bar 80 is reciprocatingly driven, each punch plate 84, 84*a* passes across the associated slit to cut off the end tip of the anchor wire 78, 78*a* in each operating stroke of the associated filling tool. FIG. 9, shows the position of the punch bar 80 after having cut off the end tip of the continuous anchor wire.

In the embodiments shown in FIGS. 7 and 8, each filling tool has a tool slide composed of two slide members which are axially movable with respect to each other. By an appropriately timed axial shifting of the slide members with respect to each other, the tuft receiving gap 42 (FIG. 2) can be closed after the introduction of each fiber tuft to facilitate the passing of the anchor cut off from the continuous anchor wire.

In an embodiment where each filling tool has a single slide member, the slide members of the two filling tools are preferably driven in synchronism if they are note rigidly connected with each other or form an integral unit. In this case, the tuft receiving gap 42 (FIG. 2) is not closed but remains open: The anchor is only held on one side of the center channel of the respective filling tool when the anchor is passing through it. The other side is open, but the dimension of the opening is kept small enough so that the anchor will not drop out.

In a still further embodiment, the slide members of both filling tools are rigidly connected with each other or even provided as a single integral unit.

FIG. 11 shows the tuft driver members 90, 90*a* extending from the rearward end of the filling tools 20, 22. The outer ends of the tuft driver members 90, 90*a* are individually connected to a common actuator 92 mounted for reciprocating movement on guide rails 94, through a respective load sensing contact pair 96, 96*a* the contacts of which are separated by a pressure spring as shown in FIG. 12. In the embodiment of FIG. 13, the outer ends of the tuft driver members 90, 90*a* are interconnected by a bridge member 98 which is in turn connected to the actuator 92 of FIG. 12 through a single load sensing contact pair 96. In either embodiment, when the load encountered in the tuft driver system exceeds a predetermined value, the force of the spring separating the associated contact pair is overcome and the contacts are closed. Closure of the contacts may be detected to sense an overload condition and to enable an appropriate corrective function, for example a standstill of the machine permitting an operator to remove the cause of the overload.

Figure 14:
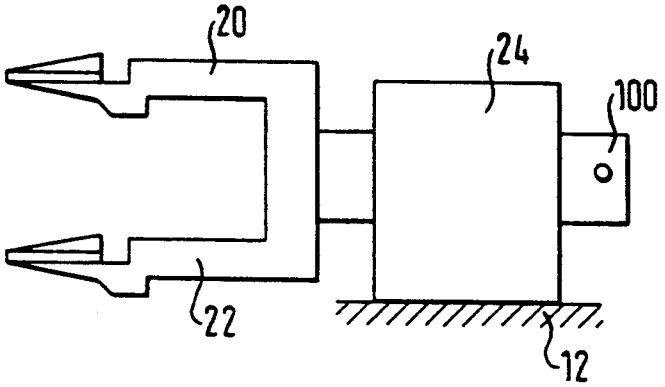
FIG. 14 is a schematic side view of an alternative arrangement of the pair of filling tools in a common filling tool box.

FIG. 14 shows an alternative embodiment wherein both filling tools 20, 22 are connected to a common tool slide 100 mounted for reciprocating movement in the filling tool box 24.

The brush filling machine of the present invention is adapted to be operated in a specific manner which is permitted by the described arrangement of the various operating units of the machine. During the filling of a brush body with fiber tufts, each filling tool performs a number of operating strokes corresponding to the number of fiber tufts to be anchored in the brush body. After the simultaneous filling of a pair of brush bodies is completed, the rotary turret 10 is indexed to present a pair of fresh brush bodies to be filled. During the indexing of the rotary turret 10, the periodic operation of the filling tools 20, 22, of the tuft picker units, the punch members and the tuft driver members is not interrupted and not even retarded. These operating units of the brush filling machine continue to operate as if no indexing of the rotary turret 10 had occurred in the meantime. This means that the indexing speed of the rotary turret 10 must be extremely high so that acceleration, a 90° rotation and the stopping of the turret in its new position must be performed within a few tenths of milliseconds. From a practical point of view, this extremely high indexing speed can be achieved with minimum radial dimensions of the turret only. By minimizing the spacing a between the axes of the pair of filling tools 20, 22 the radial dimensions of the turret 10 can be minimized. With minimum radial dimensions of the rotary turret 10, its inertia is kept sufficiently low to permit the required fast indexing.

Although the preferred embodiment has a turret designed to be indexed at 90° steps, other embodiments can be envisaged wherein the indexing step is more or less than 90°, for example 120° for a turret having three lateral brush body gripping faces.

Figure 15:
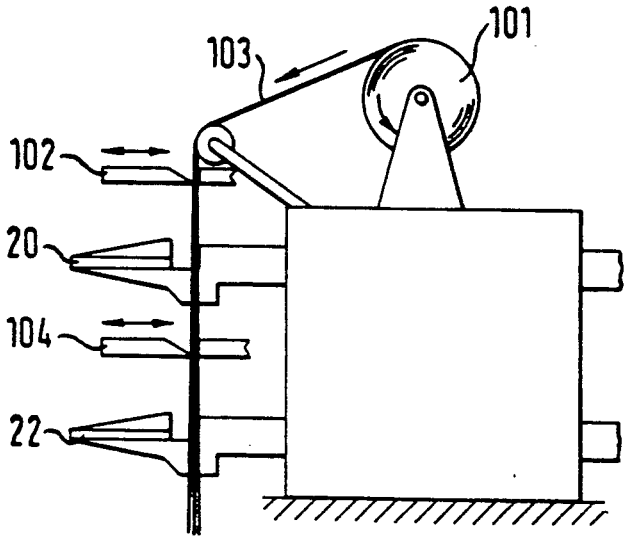
FIG. 15 shows an alternative embodiment of a tuft supply system.
Figure 16:
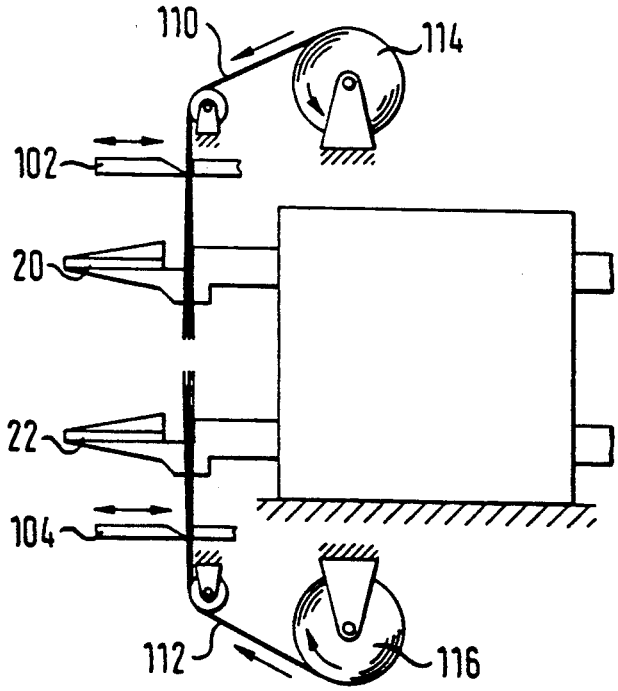
FIG. 16 shows a still further embodiment of the tuft supply system.

In the alternative embodiments shown in FIGS. 15 and 16, the fiber tufts are not supplied from a fiber box where individually cut lengths of fiber are accommodated, but supplied as a strand of fibers to each filling tool. More specifically, and referring to FIG. 15, a continuous strand 103 of individual fibers the number of which corresponds to the number of fibers in each tuft is supplied to the pair of filling tools 20, 22 transverse to their slide members to pass in front of the respective fiber gap. The fiber strand 103 can be supplied from a single spool 101 or from a number of individual spools (not shown) each accommodating a single continuous fiber. A tuft cutter 102, 104 is associated with each filling tool to cut off two successive lengths from the end of the fiber strand 103 to provide fiber tufts of the required length to each of the filling tools 20, 22. As the spacing between the filling tools 20, 22 is adjusted to its minimum possible value, the two lengths of strand which are simultaneously cut from the fiber strand 103 by the tuft cutters 102, 104 are adjacent to each other, and only one cut is required for each tuft to be severed from the strand. Synchronism of operation between the pair of tuft cutters 102, 104 is obtained by connecting them to a common cutter drive (not shown).

In the embodiment of FIG. 16, an individual strand of fibers 110, 112 is supplied to each filling tool 20, 22 from a respective spool 114, 116, and each tuft cutter 102, 104 is provided upstream from its associated filling tool.

The embodiments of FIGS. 15 and 16 do not require a tuft picker and a fiber box and are, in this respect, less complex than the embodiments of FIGS. 1 to 14.

I claim:

1. A brush filling machine having a frame, a rotary turret mounted in the frame, a brush body feeding system for supplying brush bodies to the turret, a take-off system for removing filled brush bodies from the turret and a pair of filling tools having their fiber tuft delivery openings facing one of a plurality of lateral gripping faces of the turret, each gripping face of the turret having gripping means for releasably holding a pair of adjacent brush bodies, said pair of filling tools having their tool slides slidably mounted in a common filling tool box in a parallel and adjacent relationship, both tool slides of the pair being connected to a common tool slide drive, each filling tool having an anchor wire feed channel extending transverse to the direction of sliding movement of the tool slides and opening next to the opposed faces of two adjacent tool sides, each filling tool having a punch member mounted for reciprocating movement in the filling tool box transverse to the sliding movement direction of the tool slides and having a cutting edge adjacent to the open end of an associated anchor wire feed channel, each filling tool having a tuft picker member reciprocatingly pivoting about a common axis parallel to the axis of reciprocating movement of said punch members, the tuft picker members being parallel and spaced from each other and being connected to a common tuft picker drive, and each tuft picker member cooperating with at least one associated fiber supply box, the at least one fiber supply box of one of the filling tools being mounted on top of the at least one fiber supply box of the other of the filling tools.

2. The brush filling machine according to claim 1, wherein a first one of said tuft picker members is connected to a pivot arm and a second one of said tuft picker members is connected to said first tuft picker member by a spacer, said pivot arm being mounted for reciprocating pivotal movement on one side of said filling tool box.

3. The brush filling machine according to claim 1, wherein each tuft picker member is connected to an associated pivot arm, both pivot arms being mounted for pivotal reciprocating movement on one of two opposed sides of said filling tool box.

4. The brush filling machine according to claim 3, wherein one of said pair of slide members of one tool slide is mounted directly on top of one of said pair of slide members of the other tool slide.

5. The brush filling machine of claim 4, wherein the other of said pair of slide members of each tool slide has an opening through which the shaft of an associated punch bar extends, a cutting plate for cooperation with said punch member being located on the side of said one slide member of each pair which faces said other slide member of each pair.

6. The brush filling machine according to claim 5, wherein said punch bar has an end section of each of said anchor wire feed channels formed therein and defined on one side by a punch plate.

7. The brush filling machine according to claim 6, wherein said punch plate has an edge adjacent a cutting edge of a cutting plate, said cutting plate being arranged between an opposed guiding plate and an adjacent tool slide member, said guiding plate and said cutting plate defining a slit for receiving an end tip of the anchor wire to be cut off by said punch plate on said cutting edge when said punch bar is moved in reciprocating manner.

8. The brush filling machine according to claim 7, wherein each guiding plate abuts an adjacent tool slide member on its side opposite to the cutting plate.

9. The brush filling machine according to claim 1, wherein each tool slide comprises a pair of cooperating, mutually axially slidable slide members.

10. The brush filling machine according to claim 1, wherein each tool slide has a lateral recess with an axial length substantially corresponding to the operating stroke of the tool slide, said lateral recess extending radially inwardly to an axial center channel of the tool slide and accommodating a punch bar slidingly mounted in said filling tool box, and said punch bar carrying said punch member.

11. The brush filling machine according to claim 1, wherein each of the fiber supply boxes has a bottom plate which is adjustable in height.

12. The brush filling machine according to claim 1, wherein each filling tool is associated with a pair of fiber supply boxes arranged side by side on the same level for receiving two types of fibers.

13. The brush filling machine according to claim 12, wherein each tuft driver member is individually connected to said actuator through an associated load sensing means.

14. The brush filling machine according to claim 12, wherein said tuft driver members are interconnected by a bridge member on their outer free ends, said bridge member being connected to said actuator through a single load sensing means common to both tuft driver members.

15. The brush filling machine according to claim 1, wherein said punch members have their axes aligned with each other.

16. The brush filling machine according to claim 1, wherein each filling tool has a tuft driver member slidingly received in an axial channel of the respective tool slide, both tuft driver members being connected to a common actuator.

17. The brush filling machine according to claim 16, wherein the tuft driver members are connected to said common actuator via load sensing means, said load sensing means comprising contact means which, upon sensing of a predetermined maximum load, provide a signal for enabling a corrective function.

18. A brush filling machine having a frame, a rotary turret mounted in the frame, a brush body feeding system for supplying brush bodies to the turret, a take-off system for removing filled brush bodies from the turret and a pair of filling tools having their fiber tuft delivery openings facing one of a plurality of lateral gripping faces of the turret, each gripping face of the turret having gripping means for releasably holding a pair of adjacent brush bodies, said pair of filling tools having their tool slides slidably mounted in a common filling tool box in a parallel and adjacent relationship, both tool slides of the pair being connected to a common tool slide drive, each filling tool having an anchor wire feed channel extending transverse to the direction of sliding movement of the tool slides and opening next to the opposed faces of two adjacent tool slides, each filling tool having a punch member mounted for reciprocating movement in the filling tool box transverse to the sliding movement direction of the tool slides and having a cutting edge adjacent to the open end of an associated anchor wire feed channel, a continuous strand of parallel fibers being supplied to each filling tool from at least one spool transverse to the sliding movement of the tool slides, a tuft cutter being associated with each filling tool to cut off individual fiber tufts from the fiber strand, and said tuft cutters being connected to a common tuft cutter drive.

19. The brush filling machine according to claim 18, wherein said punch members have their axes aligned with each other.

20. The brush filling machine according to claim 18, wherein each filling tool has a tuft driver member slidingly received in an axial channel of the respective tool slide, both tuft driver members being connected to a common actuator.

21. The brush filling machine according to claim 18, wherein a first one of said tuft picker members is connected to a pivot arm and a second one of said tuft picker members is connected to said first tuft picker member by a spacer, said pivot arm being mounted for reciprocating pivotal movement on one side of said filling tool box.

22. The brush filling machine according to claim 18, wherein each tuft picker member is connected to an associated pivot arm, both pivot arms being mounted for pivotal reciprocating movement on one of two opposed sides of said filling tool box.

23. The brush filling machine according to claim 18, wherein each tool slide comprises a pair of cooperating, mutually axially slidable slide members.

24. The brush filling machine according to claim 18, wherein each tool slide has a lateral recess with an axial length substantially corresponding to the operating stroke of the tool slide, said lateral recess extending radially inwardly to an axial center channel of the tool slide and accommodating a punch bar slidingly mounted in said filling tool box, and said punch bar carrying said punch member.

25. The brush filling machine according to claim 18, wherein each of the fiber supply boxes has a bottom plate which is adjustable in height.

26. The brush filling machine according to claim 18, wherein each filling tool is associated with a pair of fiber supply boxes arranged side by side on the same level for receiving two types of fibers.

27. A method of operating a brush filling machine having a frame, a rotary turret mounted in the frame, a brush body feeding system for supplying brush bodies to the turret, a take-off system for removing filled brush bodies from the turret and a pair of filling tools having their fiber tuft delivery openings facing one of a plurality of lateral gripping faces of the turret, each gripping face of the turret having gripping means for releasably holding a pair of adjacent brush bodies, said pair of filling tools having their tool slides slidably mounted in a common filling tool box in a parallel and adjacent relationship, both tool slides of the pair being connected to a common tool slide drive, each filling tool having an anchor wire feed channel extending transverse to the direction of sliding movement of the tool slides and opening next to the opposed faces of two adjacent tool sides, each filling tool having a punch member mounted for reciprocating movement in the filling tool box transverse to the sliding movement direction of the tool slides and having a cutting edge adjacent to the open end of an associated anchor wire feed channel, each filling tool having a tuft picker member reciprocatingly pivoting about a common axis parallel to the axis of reciprocating movement of said punch members, the tuft picker members being parallel and spaced from each other and being connected to a common tuft picker drive, and each tuft picker member cooperating with at least one associated fiber supply box, the at least one fiber supply box of one of the filling tools being mounted on top of the at least one fiber supply box of the other of the filling tools; wherein two brush bodies are supplied at one time to one lateral gripping face of said turret while two other brush bodies are being filled with fiber tufts on an adjacent lateral gripping face on said turret and two further, filled brush bodies are removed from a further lateral gripping face of said turret, said turret being indexed after each completed brush body filling cycle to present a new pair of brush bodies to be filled with fiber tufts to said filling tools, each of said filling tools performing one of successive filling strokes for each fiber tuft to be anchored in the respective brush body, and wherein the indexing of said turret is performed within the time of one of said filling strokes so that indexing of said turret causes no wait state of said filling tools.

28. A method of operating a brush filling machine of the type having a frame, a rotary turret mounted in the frame, a brush body feeding system for supplying brush bodies to the turret, a take-off system for removing filled brush bodies from the turret and a pair of filling tools having their fiber tuft delivery openings facing one of a plurality of lateral gripping faces of the turret, each gripping face of the turret having gripping means for releasably holding a pair of adjacent brush bodies, said pair of filling tools having their tool slides slidably mounted in a common filling tool box in a parallel and adjacent relationship, both tool slides of the pair being connected to a common tool slide drive, each filling tool having an anchor wire feed channel extending transverse to the direction of sliding movement of the tool slides and opening next to the opposed faces of two adjacent tool slides, each filling tool having a punch member mounted for reciprocating movement in the filling tool box transverse to the sliding movement direction of the tool slides and having a cutting edge adjacent to the open end of an associated anchor wire feed channel, a continuous strand of parallel fibers being supplied to each filling tool from at least one spool transverse to the sliding movement of the tool slides, a tuft cutter being associated with each filling tool to cut off individual fiber tufts from the fiber strand, and said tuft cutters being connected to a common tuft cutter drive; wherein two brush bodies are supplied at one time to one lateral gripping face of said turret while two other brush bodies are being filled with fiber tufts on an adjacent lateral gripping face on said turret and two further, filled brush bodies are removed from a further lateral gripping face of said turret, said turret being indexed after reach completed brush body filling cycle to present a new pair of brush bodies to be filled with fiber tufts to said filling tools, each of said filling tools performing one of successive filling strokes for each fiber tuft to be anchored in the respective brush body, and wherein the indexing of said turret is performed within the time of one of said filling strokes so that indexing of said turret causes no wait state of said filling tools

* * * * *